US006241590B1

(12) United States Patent
Heijkenskjöld

(10) Patent No.: US 6,241,590 B1
(45) Date of Patent: Jun. 5, 2001

(54) EXTERNAL ABRASIVE MACHINE

(75) Inventor: Mats Heijkenskjöld, Träffberg (SE)

(73) Assignee: Lidkoping Machine Tools AB, Lidkoping (SE)

( * ) Notice: Subject to any disclaimer, the term of this patent is extended or adjusted under 35 U.S.C. 154(b) by 0 days.

(21) Appl. No.: 09/446,976

(22) PCT Filed: Jul. 3, 1998

(86) PCT No.: PCT/SE98/01313

§ 371 Date: Dec. 30, 1999

§ 102(e) Date: Dec. 30, 1999

(87) PCT Pub. No.: WO99/01253

PCT Pub. Date: Jan. 14, 1999

(30) Foreign Application Priority Data

Jul. 4, 1997 (SE) ..... 9702588

(51) Int. Cl.[7] ..... B24B 7/00
(52) U.S. Cl. ..... 451/181; 451/180; 451/231
(58) Field of Search ..... 451/180, 181, 451/231

(56) References Cited

U.S. PATENT DOCUMENTS 3,817,149 * 6/1974 Reutlinger ..... 90/11 C
4,854,087 * 8/1989 Riha ..... 451/541
5,259,156 * 11/1993 Ronen ..... 451/143

FOREIGN PATENT DOCUMENTS 1 232 135 5/1971 (GB) .

* cited by examiner

*Primary Examiner*—Joseph J. Hail, III
*Assistant Examiner*—Shantese McDonald
(74) *Attorney, Agent, or Firm*—Burns, Doane, Swecker & Mathis, L.L.P.

(57) ABSTRACT

An abrasive machine for grinding material from an outer surface of a workpiece. The machine includes a rotationally driven casing having an opening at one axial end thereof. The opening is defined by an annular edge which constitutes a grinding wheel. A shaft is disposed within the casing and forms a space whose center axis is offset from the center axis of the casing. Disposed within the space and supported by the shaft is a clamping mechanism which holds the workpiece within the plane of the annular edge. By turning the shaft relative to the casing, the clamping mechanism and the workpiece will be moved toward or away from the path of travel of the annular edge, due to the eccentric relationship between the casing and the space.

15 Claims, 4 Drawing Sheets

EXTERNAL ABRASIVE MACHINE

The present invention relates to an external abrasive machine, i.e. a machine tool designed for removing material from the outer envelope surface of a substantially cylindrical or annular work piece and/or from flanges associated therewith, and particularly an external grinding machine for grinding the outer surface and/or flanges of bearing rings and of the type defined in the preamble of the accompanying claim 1.

Abrasive machines such as grinding machines, lapping machines, honing machines, milling machines, etcetera, are known in many slightly different designs and embodiments. It is desirous that the machine is compact and as space-saving as possible. For obtaining a good machining result it is on the other hand important that the co-operating parts of the machine have a high mutual stiffness and low tendencies of vibration. These last-mentioned properties are often obtained by giving the machine a heavy bedding and a sturdy and robust design, and therefore these two requirements are often contradictory to the desires for compactness and space-saving properties.

The purpose of the present invention is to provide an external abrasive machine which fulfils these, partly contradictory properties, and this has been obtained by giving the machine the features defined in the accompanying claim 1.

In this manner it has been possible to achieve very sort distances within the machine, which means that inexactness caused in conventional machines, e.g. by thermal influence and material elasticity in long shafts etcetera, is reduced to a minimum, thereby giving the machine a superior precision.

Hereinafter the invention will be further described with reference to an embodiment schematically shown in the accompanying drawings.

Figure 1:
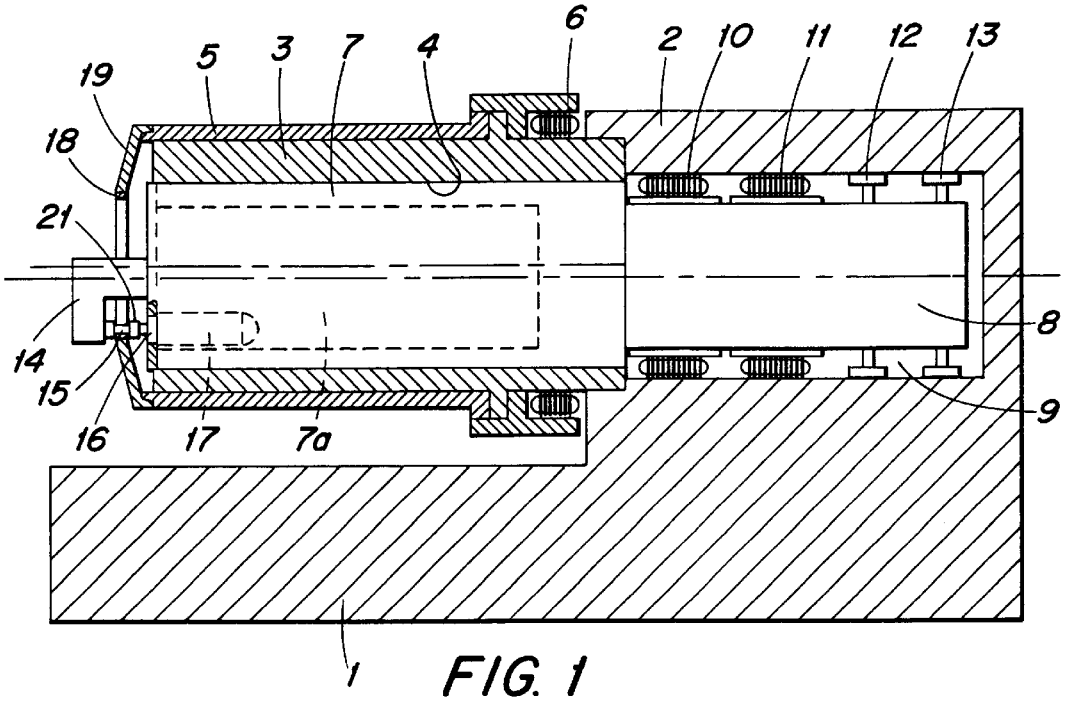
FIG. 1 shows in a longitudinal section a schematical embodiment of the external abrasive machine according to the invention.

FIG. 1 of the drawing shows schematically the main components of a new external abrasive machine, in the embodiment shown construed as an external grinder according to the present invention. Thus the machine incorporates a frame 1, in the embodiment intimated, designed as a machine bed having a portion 2 for supporting a cantilever housing, which is designed as an externally cylindrical and substantially tube-shaped elongated member 3 having a longitudinally extending bore 4, which is arranged eccentrically in relation to the longitudinal centre of the cylindrical member 3. The cylindrical member 3 is preferably—although not necessarily—non-rotatably connected to the frame 1. Rotatably supported on the outer envelope surface of the cylindrical member 3 is a rotatable outer member 5, a wheel carriage, which is driven by a motor 6, preferably an electric motor. Inside the eccentric bore 4 of the housing, there is provided a shaft 7 which can be revolved or indexed and displaced axially. This shaft 7 has a portion 8 projecting out from the housing bore 4 in a direction towards the supporting portion 2 of the frame 1, and in the embodiment intimated in the drawing, having smaller diameter than the portion of the shaft 7 received in the housing. The portion 8 of the shaft, thus projecting from the housing is received in a space 9 provided in the portion 2 of the frame 1, and in which space is provided means for revolving the shaft 7, preferably a torque motor 10 and means for axial displacement of the shaft 7, preferably a linear motor 11. The revolving and the axial displacement of the shaft is controlled by sensors 12 and 13 respectively, which preferably are also contained in the space 9 of the frame portion 2. It is evident that the means for revolving and axially displacing the shaft, need not be arranged in a manner as shown in the drawing, but may for instance be contained in a recessed portion of the shaft itself.

Figure 2:
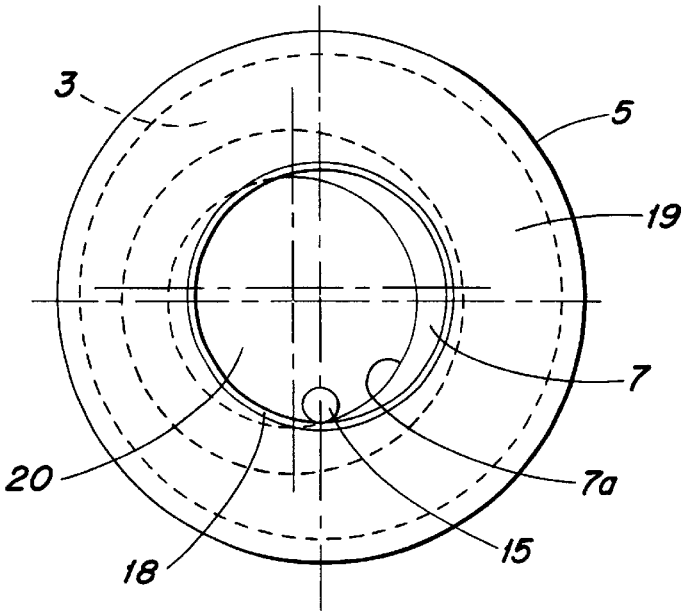
FIG. 2 is an end view of a portion of the machine as shown in FIG. 1.

Supported by the shaft 7 is a carrier 14 for an appropriate and not further shown chuck for a work piece 15, e.g. a bearing race ring, the outer envelope surface of which is to be machined, e.g. ground. At its end opposite its projecting portion 8, the shaft 7 has an inner space 7*a* (see e.g. FIG. 3), in which is supported a motor 17 with integrated work head 16, and which work heat together with the chuck are arranged to clamp therebetween a work piece 15. The rotatable outer member 5, or wheel carriage, which thus is tubular, at its front end, i.e. the end thereof adjacent the free end of the cylindrical member 3, extends slightly outside the cylindrical member 3 and is provided with a fixedly connected, substantially teller-shaped lid member 19 having a centre opening 20 (see FIG. 2). In the embodiment shown in the drawing, the edge of the opening 20 is designed as an annular grinding wheel 18. In operation the grinding wheel 18 rotates together with the outer casing 5. The carrier 14 for the chuck extends through the opening 20 and the work head 16 projects through this centre opening 20, thus that the work piece 15 retained between the chuck and the work head 16 can be displaced between positions aligned with and inside the lid member 19, following axial movement by the shaft 7, imparted thereto by the linear motor 11. The opening 20 in the lid member 19 is of such a size that it permits the work head and the chuck to pass therethrough with sufficient clearance to allow the shaft 7—and thereby the work head 16—to be revolved eccentrically relative to the lid member opening 20, thereby angularly displacing the work head 16 with the work piece 15 in a path allowing it to follow the inner periphery of the grinding wheel 18.

For obtaining dressing or trueing of the tool—the grinding wheel 18—the work head 16 is preferably provided with a dressing or trueing roller 21 causing the grinding wheel 18, or the like to receive a desired or appropriate profile, when the shaft is given a movement in relation to the tool, imparted thereto by the means for revolving and/or axial displacement.

It is evident that the chucking method used is of no vital importance for the present invention and anyone of the conventional methods can be used, such as centric chucking, micro-centric chucking or magnetic chucking.

In FIGS. 3–6 is shown in intimated cross sections different embodiments of how the main components of the abrasive machine according to the invention can be arranged and displaced angularly relative to each other.

Figure 3:
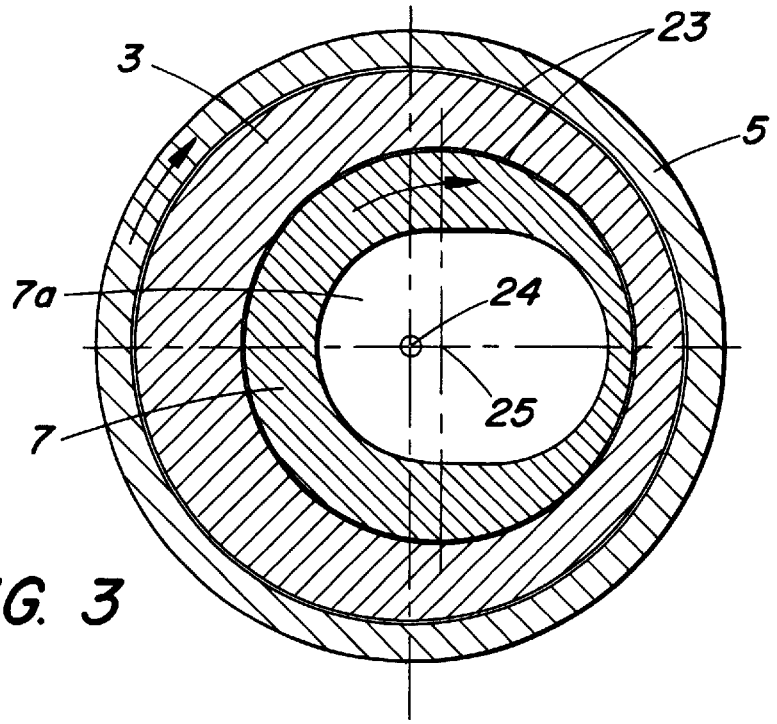
FIGS. 3–6 show diagrammatical cross sections of an end view according to FIG. 2 with the different elements of the machine in different mutual positions.

FIG. 3 thus shows how the main components, outer casing 5, housing 3 and shaft 7, with its inner space 7*a* are disposed in accordance with the embodiment shown in FIG. 1. In this embodiment the casing 5 rotates about the fixed, non-rotating housing 3, whereas the shaft 7 with aid of its motor 10 (FIG. 1) can be turned relative to the housing. For this purpose the surfaces between housing 3 and casing 5 and between housing 3 and shaft 7 are formed as bearing surfaces 23.

As seen from this figure, where the shaft and its inner space 7*a* is shown without any motor inserted, the space 7*a* in this embodiment is formed as an oblong bore. Thereby it is possible to insert motors of different size and also to position them at different positions offset from the centre 24 of the housing.

From the figure it is also clearly visible how the centre 25 is offset from the centre of the housing.

Figure 4:
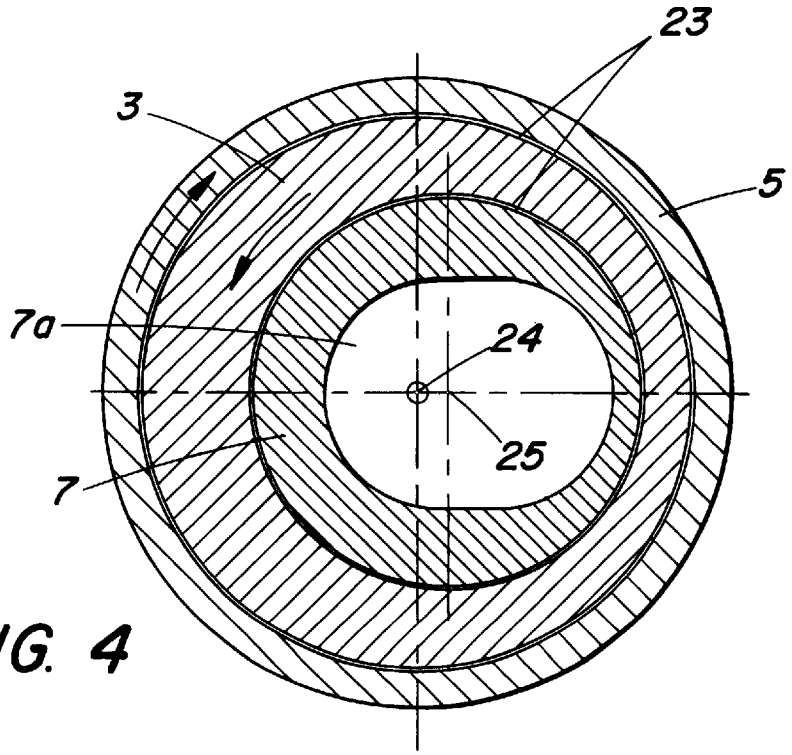

FIG. 4 shows an embodiment, which in the drawing looks alike that of FIG. 3, but which differs slightly in that the shaft 7 can be affixed and angularly immobile, whereas the housing member 3 can be turned relative to the shaft 7. The casing 5 also in this case is rotatable and bearing surfaces 23 are provided between casing 3 and housing 5 and between housing 5 and shaft 7.

Figure 5:
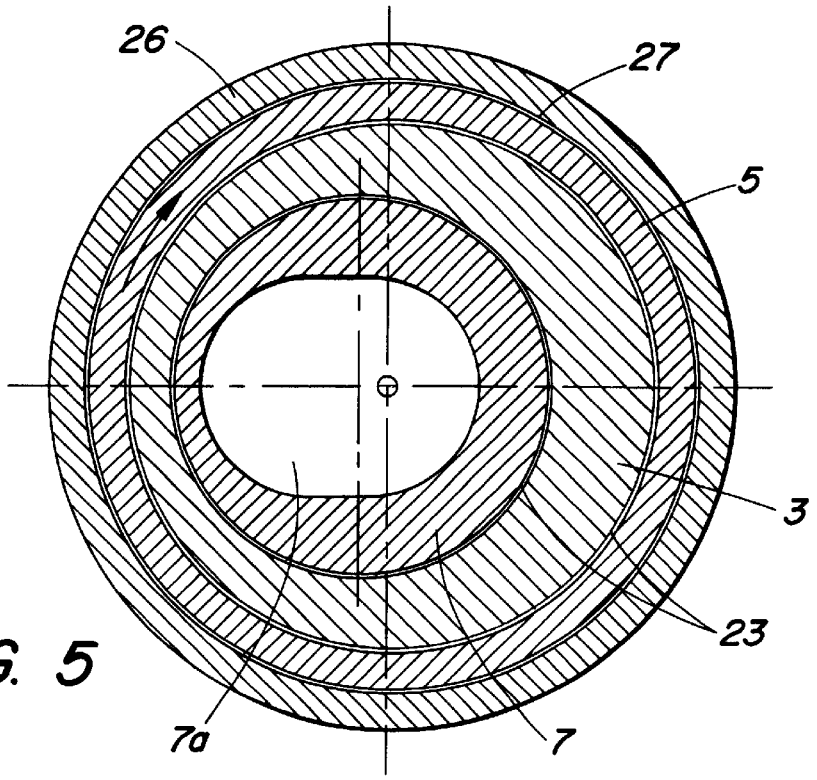

FIG. 5 shows another possible embodiment, wherein the casing 5 is provided inside an outer fixed structure 26 with a bearing surface 27 provided therebetween. Between the casing 5 and the fixed housing 3 there is in this case no bearing surface but a clearance 28.

Figure 6:
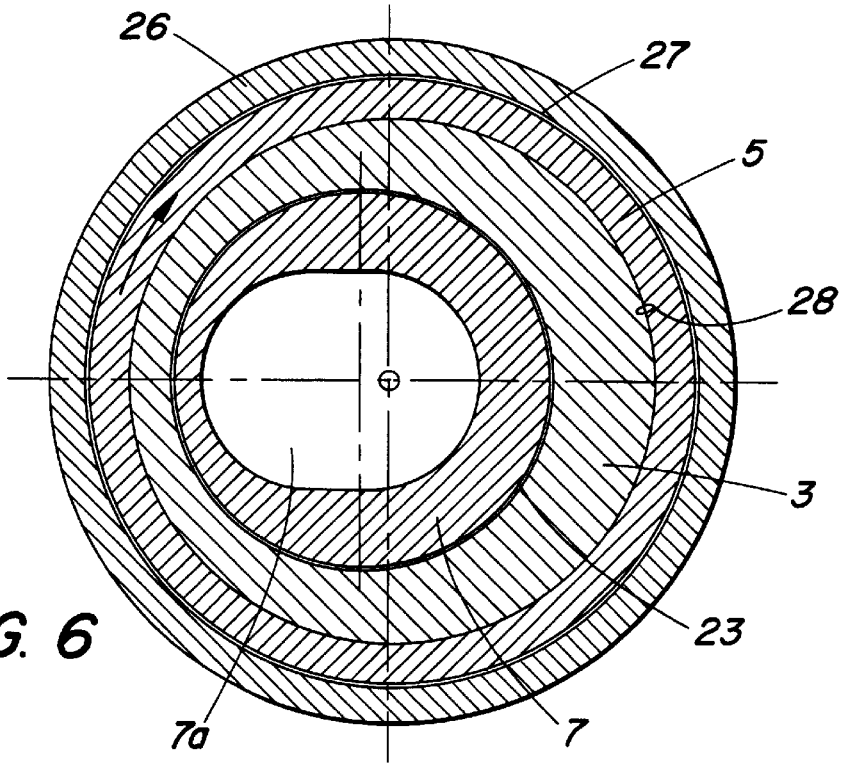

In the embodiment intimated in FIG. 6 there is provided a fixed outer structure 26 like in the embodiment shown in FIG. 5, but in this case there are provided bearing surfaces 23 also between the outer casing 5 and the housing 5, which last-mentioned is prevented from rotating.

Figure 7:
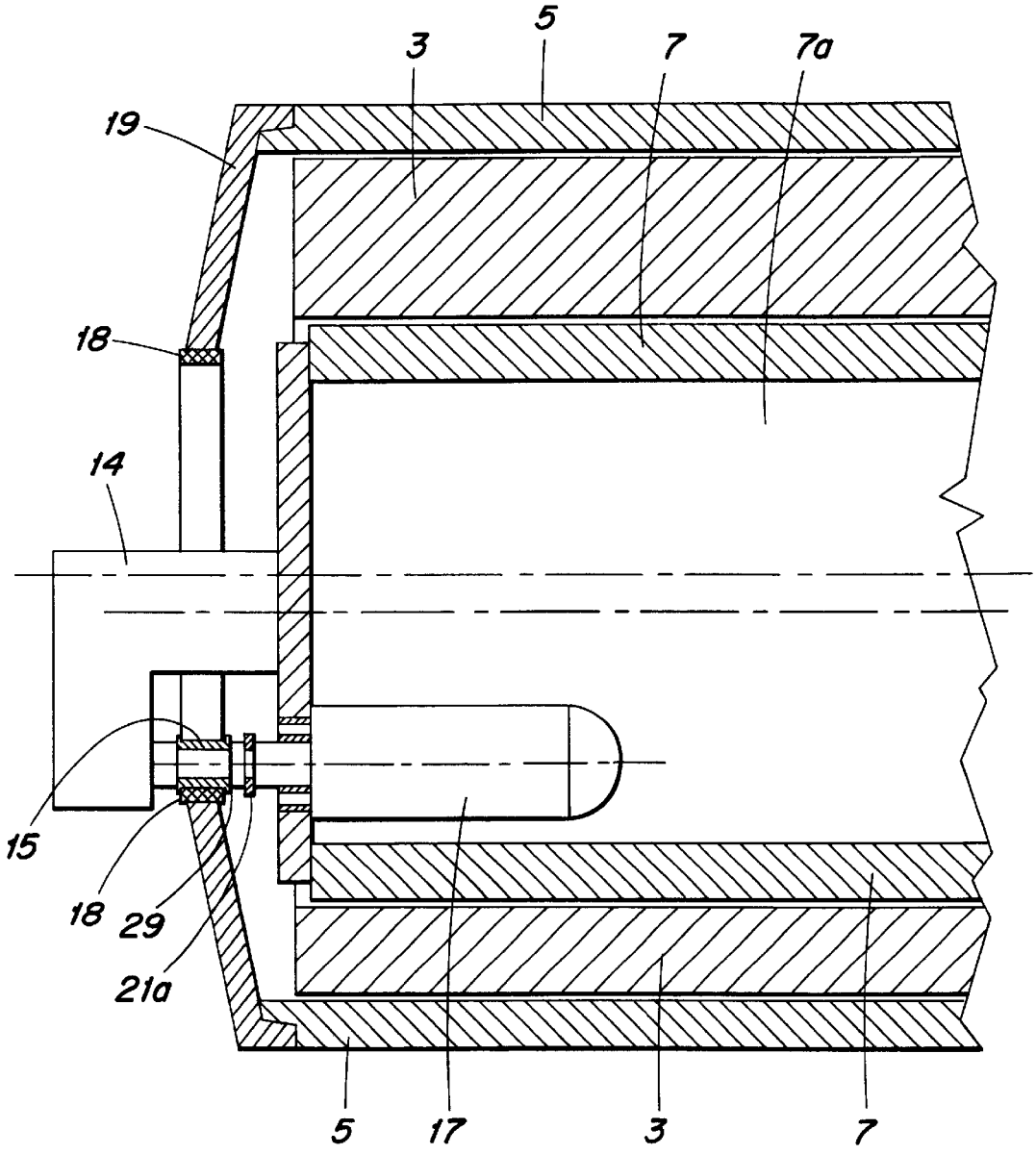
FIG. 7 shows in bigger scale a portion of the device according to FIG. 1 arranged for machining outer surface and side surfaces of external flanges on a bearing ring.

FIG. 7 shows in bigger scale a portion of a device in accordance with the device shown in FIG. 1. Thus the machine incorporates a not shown frame supporting a cantilever housing, which is designed as an externally cylindrical and substantially tube-shaped elongated member 3 having a longitudinally extending bore arranged eccentrically in relation to the longitudinal centre of the cylindrical member 3. The cylindrical member 3 is preferably non-rotatably connected to the frame. Rotatably supported on the outer envelope surface of the cylindrical member 3 is a driven rotatably outer member 5, a wheel carriage. Inside the eccentric bore of the housing, is provided a shaft 7 which can be revolved or indexed and displaced axially. Supported by the shaft 7 is a carrier 14 for an appropriate and not further shown chuck for a work piece 15, e.g. a bearing race ring, the wherein external flanges 29 and/or the outer envelope surface of which is to be machined, e.g. ground. The shaft 7 houses a motor 17 with integrated work head, which together with the chuck are arranged to clamp therebetween a work piece 15. The rotatable outer member 5, or wheel carriage, which thus is tubular, at its front end, i.e. the end thereof adjacent the free end of the cylindrical member 3, extends slightly outside the cylindrical member 3 and is provided with a fixedly connected, substantially teller-shaped lid member 19 having a centre opening, the edge of which is designed as an annular grinding wheel 18. In operation the grinding wheel 18 rotates together with the outer casing 5. The carrier 14 for the chuck extends through the opening and the work head projects through the centre opening 20, thus that the work piece 15 retained between the chuck and the work head can be displaced between positions aligned with, and inside the lid member 19, following axial movement by the shaft 7. The opening in the lid member 19 is of such a size that it permits the work head and the chuck to pass therethrough with sufficient clearance to allow the shaft 7—and thereby the work head—to be removed eccentrically relative to the lid member opening 20, thereby angularly displacing the work head 16 with the work piece 15 in a path allowing it to follow the inner periphery of the grinding wheel 18. As shown the side faces of the grinding wheel 18 can machine the side faces of both the external flanges 29 projecting radially from the bearing ring, and the inner envelope surface of the grinding wheel 18 can at the same time or in another machining step cause machining of the outer envelope surface of the work piece 15 between the two flanges thereof.

For obtaining dressing or trueing of the tool—the grinding wheel 18—the work head is also provided with a dressing or trueing roller 21*a* causing the grinding wheel 18, or the like to receive a desired or appropriate profile, when the shaft is given a movement in relation to the tool, imparted thereto by the means for revolving and/or axial displacement. This dressing of the grinding wheel can be carried trough both for the internal envelope surface of the drinding wheel 18 and for the side faces thereof.

The invention is not limited to the embodiment shown in and described in connection to the accompanying drawings, but modifications and variations are possible within the scope of the accompanying claims.

The cylindrical housing thus has been shown with a cylindrical inner space, but this space may also have other than a cylindrical shape and the shaft may have any appropriate cross section allowing it to be turned or indexed within the inner space of the housing. The shaft may even be designed as the housing of the very spindle, and it is even possible to substitute the shaft for a system of articulated links or the like capable of turning or indexing the spindle in an appropriate manner.

What is claimed is:

1. An external abrasive machine comprising: a rotatably driven tool; chucking equipment for holding a work piece to be machined; feeding means for causing relative feeding movements between the work piece and the tool; a tubular cylindrical housing having a longitudinal cylindrical inner space, said cylindrical inner space having its longitudinal axis offset from the longitudinal axis of said housing; and a shaft provided in said inner space and having a recess in which is arranged a motor coupled to a rotatable work head which together with said chucking equipment is arranged to hold and rotate a work piece to be treated; said shaft being angularly moveable in said space; the housing being enclosed by a rotatably driven outer casing, said casing being firmly connected to a lid member having an opening; the tool disposed at an inner edge of the opening; said shaft when being angularly moved in said space displacing said work head with the work piece in a path allowing the work piece to approach and contact an inner periphery of the tool.

2. An external abrasive machine as claimed in claim 1, wherein an end of the shaft opposite from said recess is rotatably arranged in a recessed portion of a supporting frame.

3. An external abrasive machine as claimed in claim 2, wherein the shaft end projecting into said recessed portion of the supporting frame is arranged to be rotated by a torque motor provided in said recessed portion.

4. An external abrasive machine as claimed in claim 2, wherein the shaft end projecting into said recessed portion of the supporting frame is axially displaceable by actuation from a linear motor.

5. An external abrasive machine as claimed in claim 1, wherein the recess in the shaft is shaped to receive motors of different size.

6. An external abrasive machine as claimed in claim 1, wherein the work head is axially displaceable by actuation of the feeding means, between a position wherein the work piece is aligned with said opening and a position wherein the work piece is misaligned with said opening.

7. An external abrasive machine as claimed in claim 6, wherein the work head is equipped with a dressing device for dressing the tool.

8. An external abrasive machine as claimed in claim 6, wherein the dressing device comprises a dressing roller having a profile configured complementary to a desired profile of the tool.

9. An external abrasive machine as claimed in claim 6, wherein the dressing device comprises a dressing disc for dressing an inner envelope surface and side faces of the tool.

10. An external abrasive machine as claimed in claim 1, wherein the housing is fixedly attached to the frame and the rotatable outer casing is driven by a motor carried by the housing.

11. An external abrasive machine according to claim 1, wherein the shaft is equipped with sensors for controlling angular and axial movements thereof.

12. An external abrasive machine according to claim 1, wherein the feeding means for causing relative feeding movements between the work piece and the tool comprises electric motors.

13. An external abrasive machine as claimed i claim 1, wherein the tool comprises a grinding wheel.

14. An external abrasive machine as claimed in claim 1, wherein the recess in the shaft is shaped in a manner so as to allow positioning of said motor at different offset positions from the center of the shaft.

15. An external abrasion machine as claimed in claim 1, wherein the work head is equipped with a trueing device for trueing the tool, when the work head is advanced to a position with the trueing device approaching and contacting an edge of the tool.

* * * * *